US011957196B2

(12) United States Patent
Giorgini

(10) Patent No.: US 11,957,196 B2
(45) Date of Patent: Apr. 16, 2024

(54) TEMPERATURE-REGULATING GARMENT AND AIR EXCHANGE SYSTEM

(71) Applicant: Treré Innovation S.r.l., Asola (IT)

(72) Inventor: Fabio Giorgini, Monticelli Brusati (IT)

(73) Assignee: TRERE' INNOVATION S.R.L., Asola (IT)

( * ) Notice: Subject to any disclaimer, the term of this patent is extended or adjusted under 35 U.S.C. 154(b) by 0 days.

(21) Appl. No.: 16/958,031

(22) PCT Filed: Dec. 17, 2018

(86) PCT No.: PCT/IT2018/000165
§ 371 (c)(1),
(2) Date: Jun. 25, 2020

(87) PCT Pub. No.: WO2019/130366
PCT Pub. Date: Jul. 4, 2019

(65) Prior Publication Data

US 2021/0059333 A1 Mar. 4, 2021

(30) Foreign Application Priority Data

Dec. 29, 2017 (WO) ..... 102017000151111

(51) Int. Cl.
*A41D 31/102* (2019.01)
*A41D 27/28* (2006.01)
(Continued)

(52) U.S. Cl.
CPC ..... *A41D 31/102* (2019.02); *A41D 27/28* (2013.01); *A41D 31/125* (2019.02); *A41D 31/14* (2019.02);
(Continued)

(58) Field of Classification Search
CPC ..... D04B 1/24; A41D 31/102; A41D 27/28; A41D 31/125; A41D 31/14; A41D 31/02;
(Continued)

(56) References Cited

U.S. PATENT DOCUMENTS 4,732,015 A 3/1988 Abrams et al.
5,378,529 A * 1/1995 Bourdeau ..... A41D 31/12 428/36.1
(Continued)

FOREIGN PATENT DOCUMENTS

JP 2017-145542 8/2017
WO 98/01047 1/1998
(Continued)

OTHER PUBLICATIONS

International Search Report dated Apr. 8, 2019 in International (PCT) Application No. PCT/IT2018/000165.

*Primary Examiner* — Aiying Zhao
(74) *Attorney, Agent, or Firm* — Wenderoth, Lind & Ponack, L.L.P.

(57) ABSTRACT

A temperature-regulating garment and air exchange system including a fabric composed of a background yarn (11) which is visible on the rear and a base yarn (12) which is visible on the front of the fabric, and a third yarn (2) which allows the construction of a structure which lends the fabric the desired performance characteristics. In particular, in a zone designed to absorb and expel perspiration and be breathable, the garment features a fabric structure obtained by machining the background yarn and the base yarn with a looser knit with respect to other portions in which such performance is not required, so as to permit good passage of air, and the third yarn is added by inserting the yarn into a portion of row of knitting which is clearly defined in terms
(Continued)

of the width thereof and which corresponds to the width of the breathable area to be obtained.

11 Claims, 8 Drawing Sheets

(51) Int. Cl.
*A41D 31/02* (2019.01)
*A41D 31/12* (2019.01)
*A41D 31/14* (2019.01)
*D04B 1/24* (2006.01)

(52) U.S. Cl.
CPC ..... *D04B 1/24* (2013.01); *A41D 31/02* (2013.01); *A41D 2500/10* (2013.01); *A41D 2600/10* (2013.01)

(58) Field of Classification Search
CPC ..... A41D 2500/10; A41D 2600/10; A41B 2400/20; A41B 2400/22; D10B 2403/0111; D10B 2403/0114; D10B 2403/021; D10B 2403/0213; D10B 2403/0223
USPC ..... 66/171; 2/DIG. 1
See application file for complete search history.

(56) References Cited

U.S. PATENT DOCUMENTS

| | | | | |
|---|---|---|---|---|
| 5,783,277 | A | 7/1998 | Rock et al. | |
| 5,817,391 | A * | 10/1998 | Rock | A47C 31/006 428/95 |
| 6,156,406 | A * | 12/2000 | Rock | B32B 5/06 428/86 |
| 2005/0086721 | A1 | 4/2005 | Lambertz | |
| 2005/0282455 | A1* | 12/2005 | Foshee | D04B 1/14 66/7 |
| 2008/0189824 | A1* | 8/2008 | Rock | D04B 1/04 36/43 |
| 2010/0100994 | A1 | 4/2010 | Ehlmé | |
| 2011/0179544 | A1* | 7/2011 | Courvoisier | A41D 27/13 2/53 |
| 2018/0338563 | A1* | 11/2018 | Moretti Polegato | B32B 5/026 |

FOREIGN PATENT DOCUMENTS

| | | |
|---|---|---|
| WO | 2008/118070 | 10/2008 |
| WO | 2010/004175 | 1/2010 |

* cited by examiner

TEMPERATURE-REGULATING GARMENT AND AIR EXCHANGE SYSTEM

TECHNICAL FIELD

The present invention relates to a temperature-regulating garment including an air exchange system which are particularly suitable to create differentiated zones having specific, localised transpiration and temperature regulation, which allow garment sectors to be obtained having a precise function, clearly identified according to the position, in order to obtain effective transpiration and accurate, homogeneous temperature regulation over pre-established areas of skin which are particularly prone to perspiration.

Nowadays, the need for clothing items with increasingly specialised and particular types of performance is leading researchers to develop increasingly higher performing fabrics aimed at meeting extremely specific requirements concerning comfort, transpiration, temperature regulation, etc.

BACKGROUND ART

As is known, for sports activities, users are required to wear apparel which meets well-defined requirements; indeed, the garment must be an item which is comfortable to wear and must offer specific characteristics according to the sports discipline for which the garment is made. Indeed, for different sports disciplines, the item of clothing must offer optimal adherence to the body and lightness, characteristics that guarantee a high level of comfort, must be functional and must ensure the wearer the widest range of movement and wellbeing.

In particular, the items of clothing are required to protect the wearer from the external environment during sports activities and keep the temperature of the skin as close to body temperature as possible, therefore those items must be able to allow air through when necessary in order to disperse the heat which develops with physical activity or to create a barrier against heat dispersion when the external temperature is particularly low.

At present, in many sporting activities, it is customary to dress in layers in order to create an environment which meets, as closely as possible, the needs of the kind of movement carried out during sports activities.

While allowing one or more layers to be removed as needed, the layering of clothing results, conversely, in the wearer being 'bundled up' in a way that is no longer acceptable because it limits movement and, consequently, comfort and results in the need to manage the garments removed, which become a "dead weight" to be dealt with.

Furthermore, one need which is felt very strongly by sportsmen and women is the need for clothing items which are particularly breathable in well-defined areas and are able to ensure evaporation of the perspiration produced, with movement, by the fabric too, thereby protecting the wearer's body from the temperature difference between body heat and the temperatures of the surrounding environment. This need is felt particularly strongly, for example, in skiing, where the differences in temperature between the body and the external environment are considerable.

From studies carried out, it has been found that, if the temperature increases too much, this can cause damage to the cellular matrix of muscles since the movement of the muscle fibres at certain temperatures and under stress is not optimal.

The cellular chemistry that ensures muscle contraction is affected because the thermal shock between the warmer and cooler zones can cause the stagnation of the liquids resulting from thermal shock in the points where there is a change of temperature from a vascular viewpoint.

Moreover, the effects of the phenomena just described are amplified when the external temperature is much lower than the body temperature, as is the case during skiing.

In particular, the lack of dissipation and/or irregular dissipation triggers a forced, further increase in temperature, which leads to an acceleration of the aforesaid effects which, over distance and time, cause vascular erosion.

Furthermore, excessive heating reduces the viscosity of the liquid surfactants present in the muscles, with the result that performance is reduced, increasing the risk of cellular and muscle damage. Furthermore, incorrect transpiration can trigger skin irritation or the proliferation of bacteria and fungi, which find an ideal habitat in a warm and damp environment.

In addition to that described so far, most items of clothing absorb the perspiration produced, but retain the latter within the fabric, which becomes weighed down, leaving an unpleasant damp feeling on the skin, as well as being harmful to the body, which alternates between a state of hot and cold, which is uncomfortable.

The applicant is aware of US patent US2005/0086721, which discloses a temperature-regulating item of clothing and the method for removing moisture from areas of the skin. In particular, in the patent, it is said that the item is made of a knitted fabric which has channels with a particular machining which allow transpiration. Furthermore, there are other areas which have a very thin layer of machining which allows the perspiration accumulated to make its way out, making it possible for the moisture to evaporate.

In the patent, a different form of temperature regulation is also disclosed, which is formed of a plurality of parallel ribs which create ventilation channels, while another is based on a fabric which is held in a wave-shaped configuration. The upper surface of the fabric thus composed is covered by a layer of containment fabric. The temperature regulation portion rests elastically on the skin dampened by the drops of perspiration. The area also has hollow spaces which are supposed to make the air circulate in order to dry the perspiration.

In more detail, the patent discloses "at least one temperature regulation zone featuring a first layer of flat fabric and a second layer of waved fabric, the said second layer of waved fabric alternately featuring tapes and reliefs, the said tapes being bound to the said first layer of fabric; and the said reliefs and the said first fabric layer defining, together, a plurality of hollow chambers".

The patent describes how the perspiration is removed from the skin as conveyed by the waved fabric, but also remains partly in the fabric because the wave is trapped between the two layers of fabric and, consequently, more time is needed in order for the moisture to evaporate. Indeed, the wave is laden with moisture, but since the wave is inside the fabric and features a rather thick weft, it does not promote rapid evaporation, so the user feels weighted due to the accumulated moisture.

As disclosed in the aforesaid patent, the machining described is carried out using two yarns: a ground yarn and a yarn used to obtain the knit of the fabric. As regards the second yarn, in order to make the temperature-regulating fabric portion, a different yarn is used from that present in the rest of the fabric.

In more detail, in the aforesaid patent, the areas of transpiration are very clearly defined and regular, with the result that perspiration is uniform and constant throughout the area, but the production of perspiration, meanwhile, varies from one point to another even within the same sector since, even within the same sector, there are areas which require greater transpiration while laterally to such area the need for transpiration is more contained.

It has been found that the fabric obtained with the machining described in the patent is a particularly thick and voluminous fabric due to the type of machining required to obtain the wave pattern, a condition which results in a heavier resultant fabric with a greater consistency. Indeed, the knit becomes thicker and this translates into heaviness of the garment, as illustrated in point (008) of the patent, which describes how the temperature-regulating zone can be composed of several layers in order to absorb a greater amount of perspiration, which then must be transported away. As a result, the knitted fabric obtained tends to be stiff and therefore not very comfortable and, over time, can cause discomfort.

In addition, due to the type of machining used to make the waved fabric, there is a noticeable accumulation of heat over the skin and in high-perspiration areas, particularly in garments for winter activities, as they cannot disperse the accumulated heat, so when the garment is removed there is a considerable difference in temperature between the skin and the surrounding environment, as well as the fact that the skin remains slightly damp.

In addition to that described so far, the patent discloses how the "temperature regulating" channels start from the moisture concentration zone, allowing part of the humidity to evaporate while the other is absorbed by the fabric and, moreover, are designed to transport the moisture towards other areas of the garment, where it can evaporate.

In addition to the description so far, there is a demand expressed by the market, linked to various sports disciplines, for increasingly ergonomic items of clothing which allow the user to perform a whole series of movements, including therein extreme ones, in total comfort and without any sense of constraint or limitation or weight, promoting, at the same time, perfect transpiration and temperature regulation, good protection of the parts of the body with which the garment comes into contact, but which also have a pleasant, attractive appearance and above all are light, soft, and decidedly not bulky and voluminous.

Summary of Invention The aim of the present invention is essentially to resolve the problems of the commonly known technique, overcoming the aforesaid drawbacks by means of a temperature-regulating garment including an air exchange system which offers a user a garment having zones with differentiated transpiration based on the need for dispersion of perspiration in a timely manner, offering the user optimal comfort, excellent breathability, but targeted and tailored to needs.

A second aim of the present invention is to provide a temperature-regulating garment including an air exchange system which lends the garment structural characteristics which translate into functional characteristics in order to obtain effective temperature regulation which leaves the skin dry, without the presence of any moisture in the fabric.

A third aim of the present invention is to provide a temperature-regulating garment including an air exchange system which has well-defined areas which are delimited according to the type of function and protection they must provide.

A further aim of the present invention is to provide a temperature-regulating garment including an air exchange system which provides zones which maintain the temperature and remove moisture from the skin, and allow the moisture to make its way out of the fabric exactly where it is produced.

A further but not final aim of the present invention is to provide a temperature-regulating garment including an air exchange system which is easy to manufacture and works well.

These aims and others besides, which will better emerge over the course of the present description, are essentially achieved by means of a temperature-regulating garment including an air exchange system, as outlined in the claims below.

BRIEF DESCRIPTION OF DRAWINGS

Further characteristics and advantages will better emerge in the detailed description of a temperature-regulating garment including an air exchange system, according to the present invention, provided in the form of a non-limiting example, with reference to the accompanying drawings, in which.

With reference to the figures, 1 denotes, as a whole, a temperature-regulating garment including an air exchange system according to the present invention.

DETAILED DESCRIPTION OF THE INVENTION

Figure 1A:
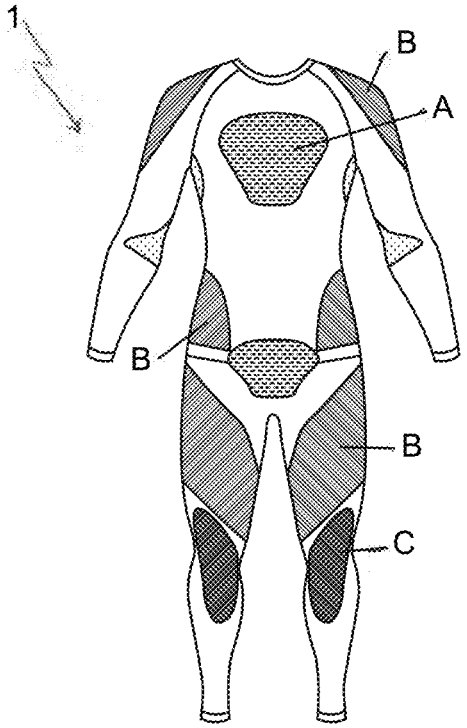
FIGS. 1A and 1B show, respectively, a front view and a rear view of a garment according to the present invention.
Figure 1B:
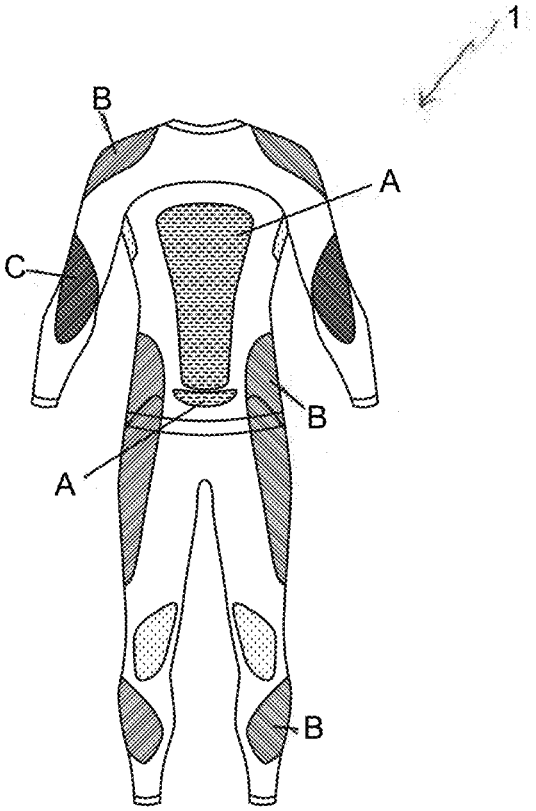

As is known, there are areas of the body which have different requirements with regards to perspiration, transpiration, and isolation from the external environment, etc., and FIG. 1 shows the different needs with reference to the different parts of the body.

In order to meet the diverse requirements, different machining (knitting) types have been carried out in pre-established zones which lend those functional characteristics sought through a knitted fabric construction.

The garment according to the present invention is substantially composed of a fabric of the conventional kind, consisting of a ground yarn 11 which is visible on the rear of the fabric and a base yarn 12 visible on the front of the fabric which create the texture of the garment.

In the areas in which specific performance is required of the garment, and therefore of the fabric, a third yarn 2 is added to the machining which allows the construction of a structure which lends the fabric the desired performance.

Figure 2:
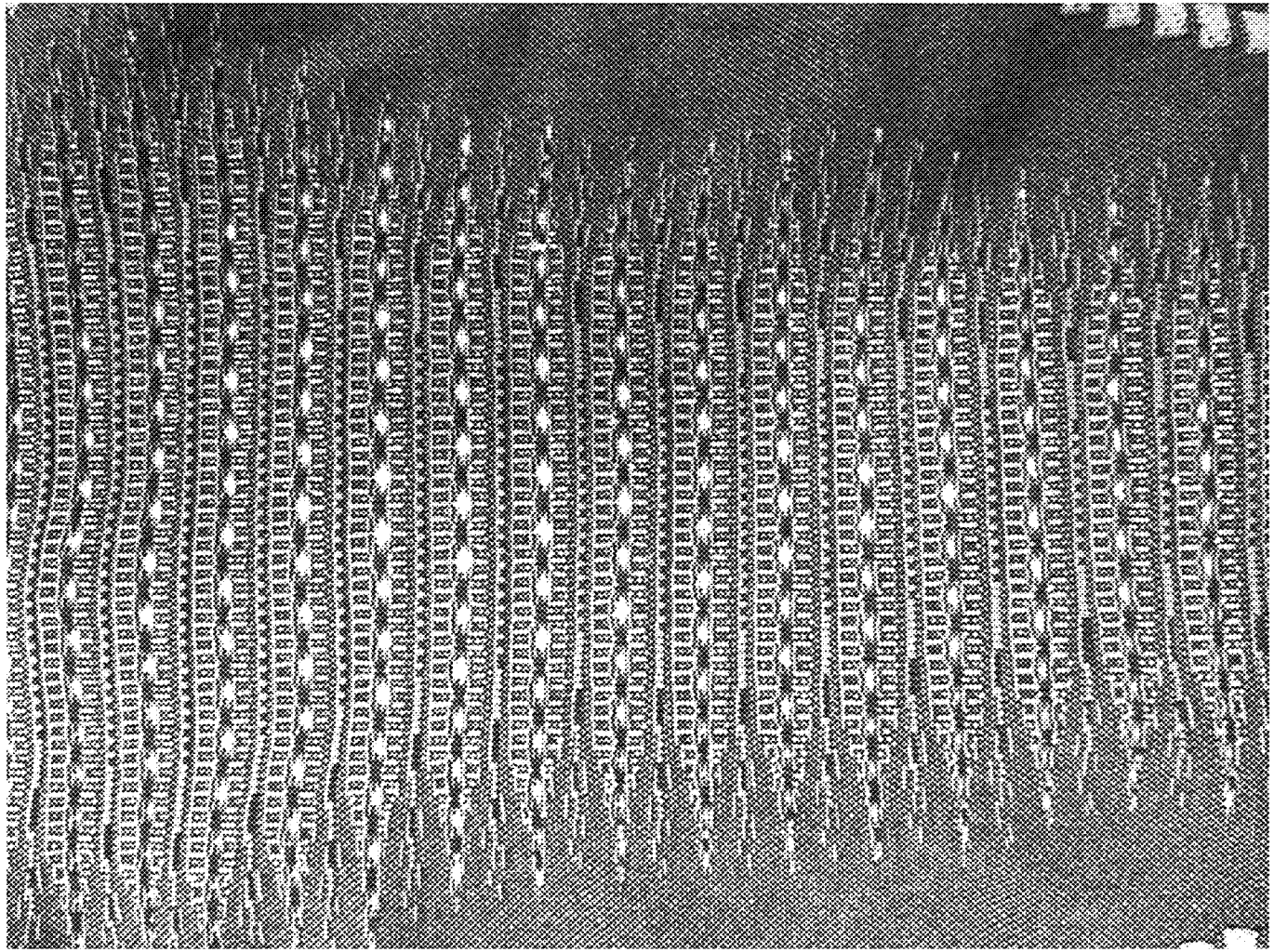
FIG. 2 shows, schematically, a first machining diagram for the dissipation of moisture and air exchange for the garment in FIG. 1.
Figure 3:
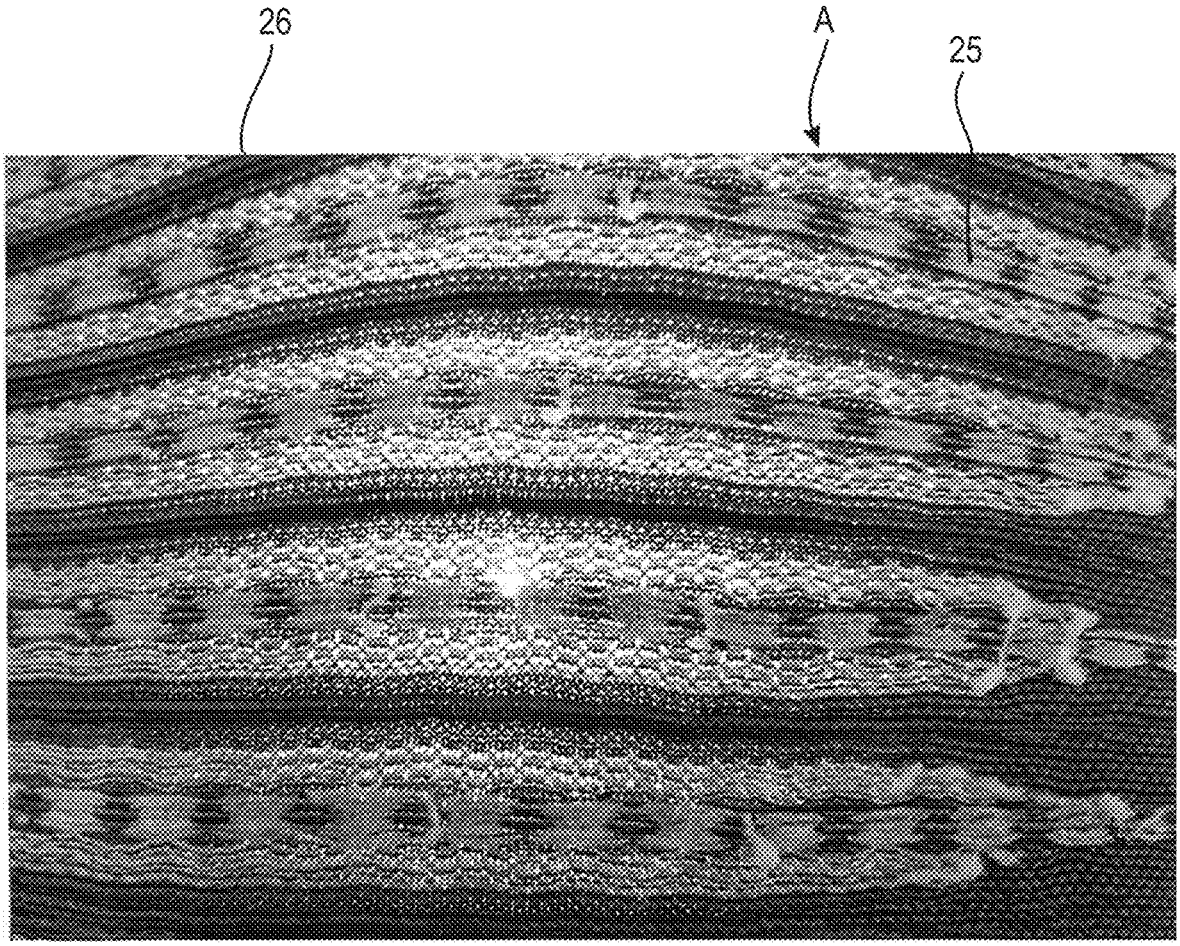
FIG. 3 shows an enlarged view of the fabric with the first machining diagram in FIG. 2.

As shown in FIG. 2, the fabric featuring the configuration shown is suitable to absorb and expel perspiration and be breathable.

Figure 4:
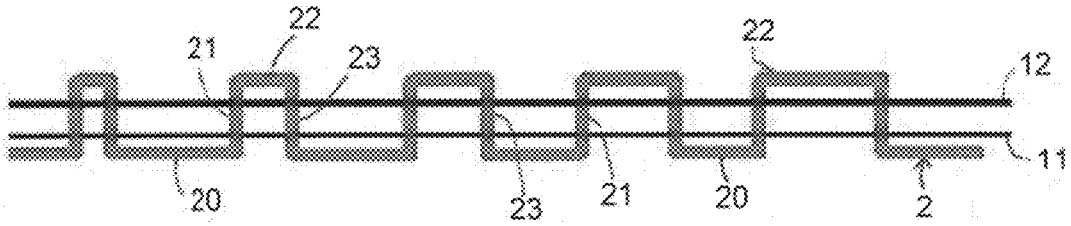
FIG. 4 shows, schematically, the arrangement of the yarns in the zones of the fabric for the machining in FIG. 2.

The structure of the fabric in this area is obtained by machining the ground yarn 11 and base yarn 12, which creates a looser knit, i.e. openwork (with respect to other portions of the garment in which such performance is not required) in order to allow a good passage of air, and the third yarn 2 is added to the machining in a portion of the row of knitting which is well defined widthwise and corresponds to the width of the breathable zone to be obtained, the portion of the row of knitting to which the third yarn is added being a performance row. In greater detail, the third yarn is worked by passing it from the inside of the fabric, which is to be in contact with the person's skin, to the outside of the fabric, which is to be exposed to the external environment, and then returning to the inside, creating a sort of "Greek fret" between the inside and the outside of the fabric, as shown schematically in FIG. 4.

Indeed, the third yarn 2 is connected to the two ground 11 and base 12 yarns and is machined in such a way that, for a first section 20, the third yarn is on the inside, then the third yarn runs through the knitting obtained with the other two yarns for a second section 21, then comes out to the outside for a third section 22, then runs through the knitting once again for a fourth section 23 and then runs back to the inside, and so on for the entire width of the area to be made.

This way of adding the third yarn is repeated over a pre-established number of parallel rows of knitting, along the desired width of the area (in a width direction of the area). In particular, within the same row of knitting, the length of the first internal section and of the third external section may vary. These differences in size of the first and third sections correspond to a different capacity of the fabric to absorb and wick away perspiration. Furthermore, as mentioned, the machining is repeated over a certain number of rows in order to create a sort of grid, as shown in FIG. 2.

In accordance with the present invention, the pattern of the grid is not regular since it is varied according to the amount of perspiration present in that zone. For example, as shown in FIG. 1, in the centre of the back there is a sector A like the one just described, since there is a confluence of perspiration in that area because a sort of natural channel is created due to vertebral morphology and the insertion of the dorsal and lumbar muscles, as a result of which the conformation and configuration of the grid follows both the area concerned and the amount of perspiration produced and, consequently, the necessary transpiration. Indeed, the size of the elements 25 of the grid varies and gradually decreases moving away from the spine towards the arms and the surface of both the external and internal elements obtained with the third yarn decreases moving towards the arms since the need for transpiration is reduced moving away from the spine.

The machining is carried out such that the first sections 20 arc longer than the third sections 22 so as to increase the amount of the third yarn 2 in contact with the skin, which increases the perspiration absorption capacity since the layout and physical characteristics of the third yarn ensure the perspiration is absorbed from the skin. The third yarn is hydrophobic and so does not become impregnated and wicks the perspiration away from the base fabric towards the outside, into contact with the air, where the perspiration evaporates, helped also by the movement of the air obtained by the presence of ribs 26.

In addition to that described so far, the machining of this sector envisages that the grid previously disclosed comprises a plurality of horizontal elongate ribs 26 with extremely small dimensions, so as not to create thicknesses in the knitting which would make the fabric obtained heavy.

Indeed the ribbing is obtained using the ground yarn 11 and the base yarn 12 and holding the stitches so as to create the volume of the fabric.

According to the present embodiment, each rib 26 is surrounded by very open, breathable machining.

In more detail, the series of ribs 26 are interposed between the Greek fret pattern so as to create secondary passages of air in which the air moves transversely with respect to the air moved by the grid structure, which moves in an essentially perpendicular direction to the skin. In this way, air circulation is created in two directions and very delicate vortices are created, which result in quick and effective evaporation of the perspiration, which is eliminated at the point where it is located.

According to the present invention and as already mentioned, the ribs promote air circulation and, consequently, transpiration; furthermore, the ribbing decreases in thickness towards the sides of the zone due to the decreasing need for air passage further away from the central area, which is subject to a greater concentration of perspiration.

As mentioned earlier, due to the configuration thereof, the ribbing allows the portion of fabric to be kept lifted just off the skin, between one rib and the next, thus facilitating transversal air circulation and therefore a flow of air parallel to the skin.

In the present embodiment, one variant envisages that, within the structure of the ribbing, there are high transpiration cells positioned at intervals so as to manage different degrees of transpiration and temperature regulation.

The cells, made using the ground yarn with a machining that provides a particularly open knit, to let air pass, ensure there is also an exchange of air inside the ribs to avoid creating zones with different temperatures that would be limiting to transpiration and to uniform, adequate temperature regulation.

Figure 5:
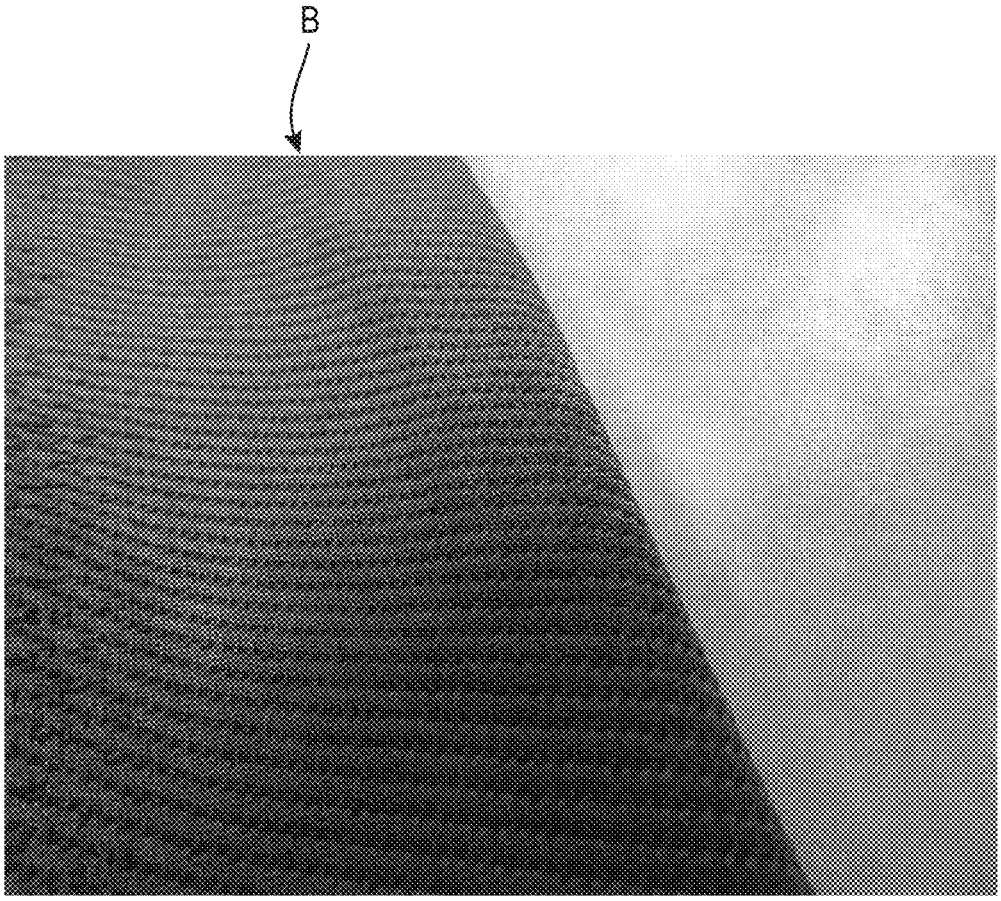
FIG. 5 shows, schematically and from the outside, a second machining diagram for the dissipation of moisture and air exchange for the garment in FIG. 1.
Figure 6:
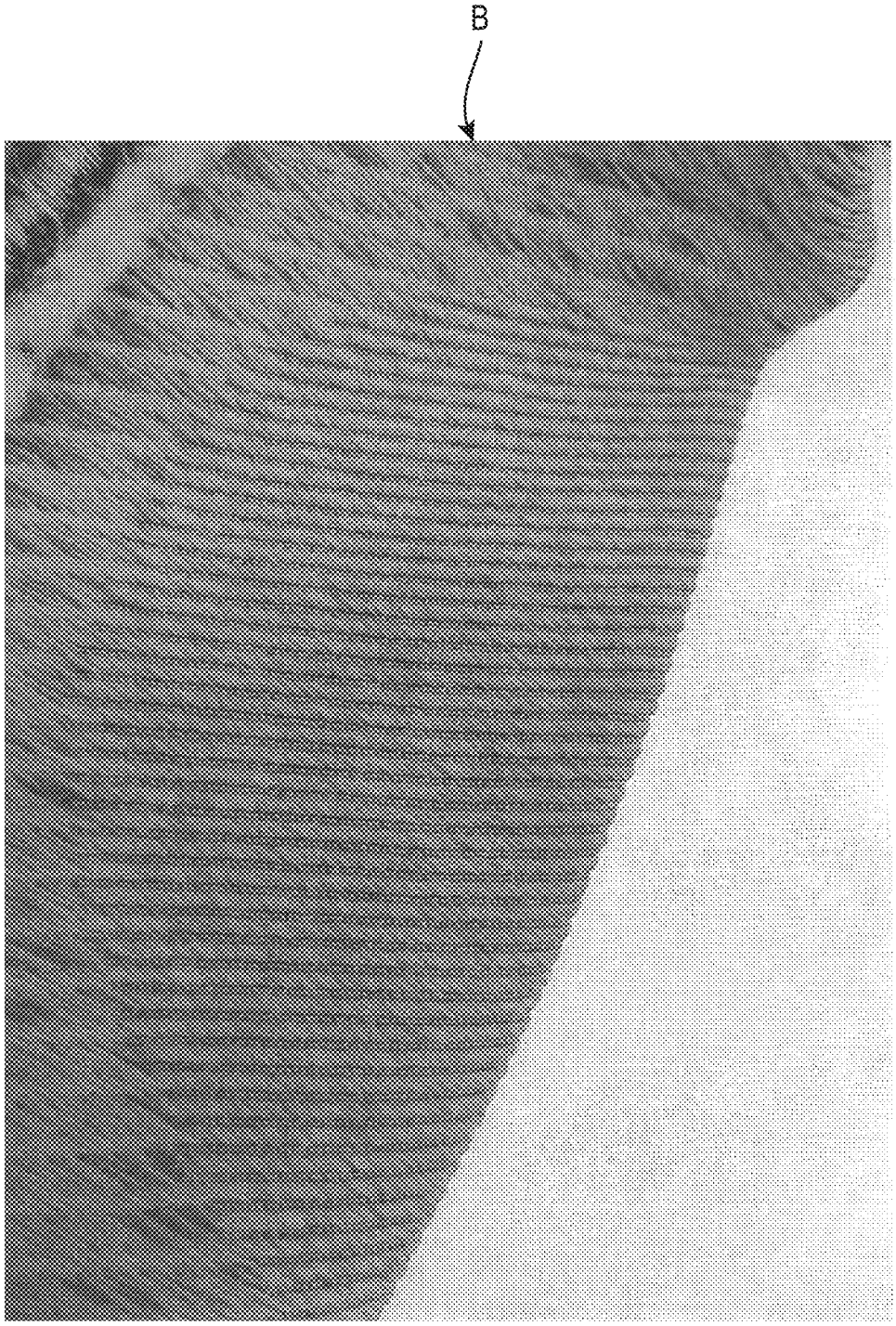
FIG. 6 shows, schematically and from the inside, the second machining diagram in FIG. 5.

A different machining present in the garment in question, shown in FIGS. 5 and 6, envisages that the third yarn comprises a Greek fret whose sections are very close to each other, thereby obtaining a more compact fabric since the performance required thereof is to insulate the skin against the external environment. Indeed, this structure of the fabric is provided in the areas of the body that need to maintain a certain temperature and avoid heat loss which would make muscle action slower and stiffer.

In these sectors (sectors B in FIG. 1), the grid is much more compact and dense for the very purpose of reducing breathability and the passage of cold air which, for example, would lead to cooling of the side and the part of insertion of the gluteus muscle, which is used considerably in skiing, and to slowing down and destabilising the mobility of the vertebral column in the lumbosacral section or in the shoulder, where the rotator cuff muscles are small and mechanically weaker and so more easily damaged.

Figure 7:
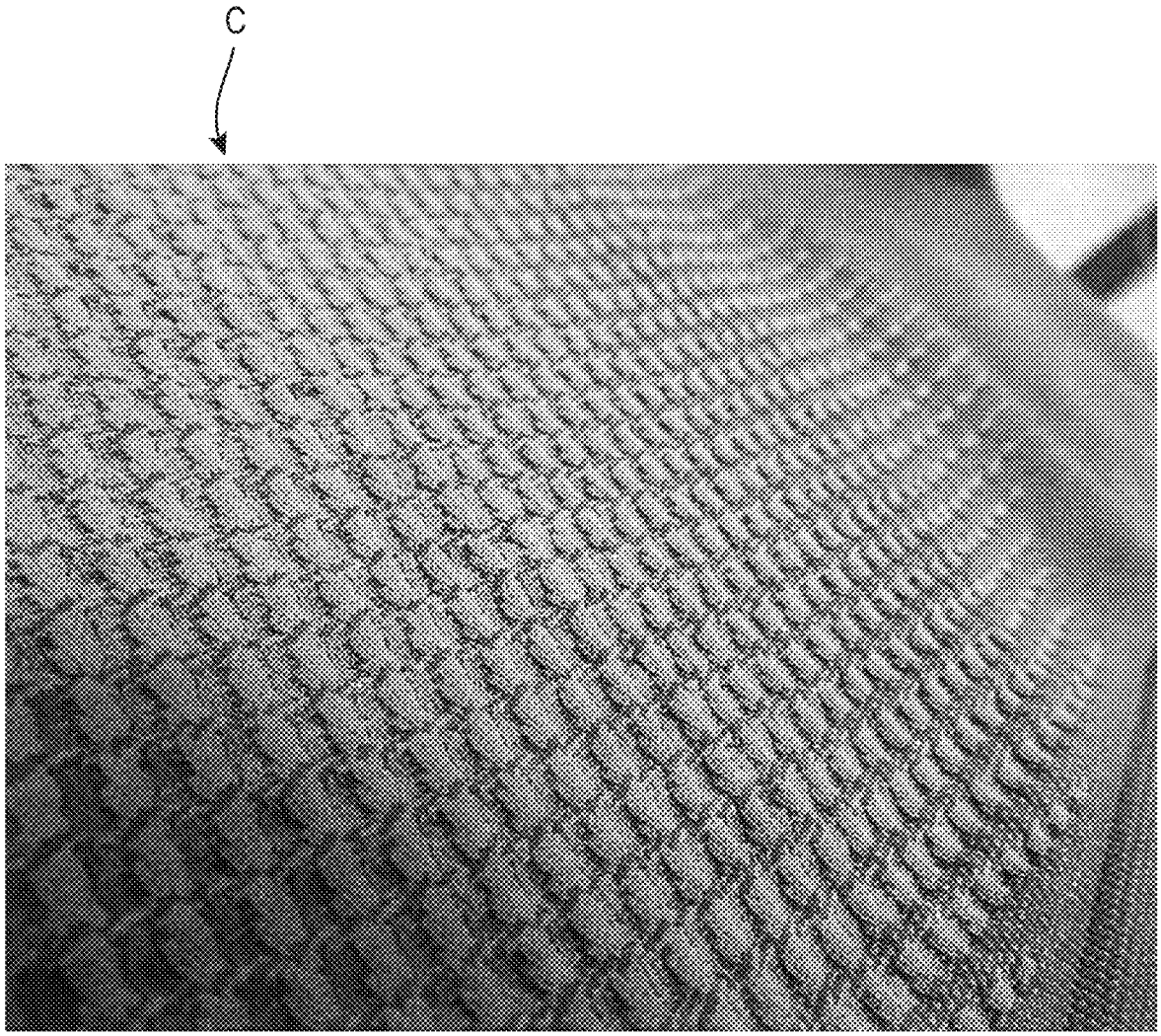
FIG. 7 shows, schematically and from the outside, a third machining diagram for the dissipation of moisture and air exchange for the garment in question.
Figure 8:
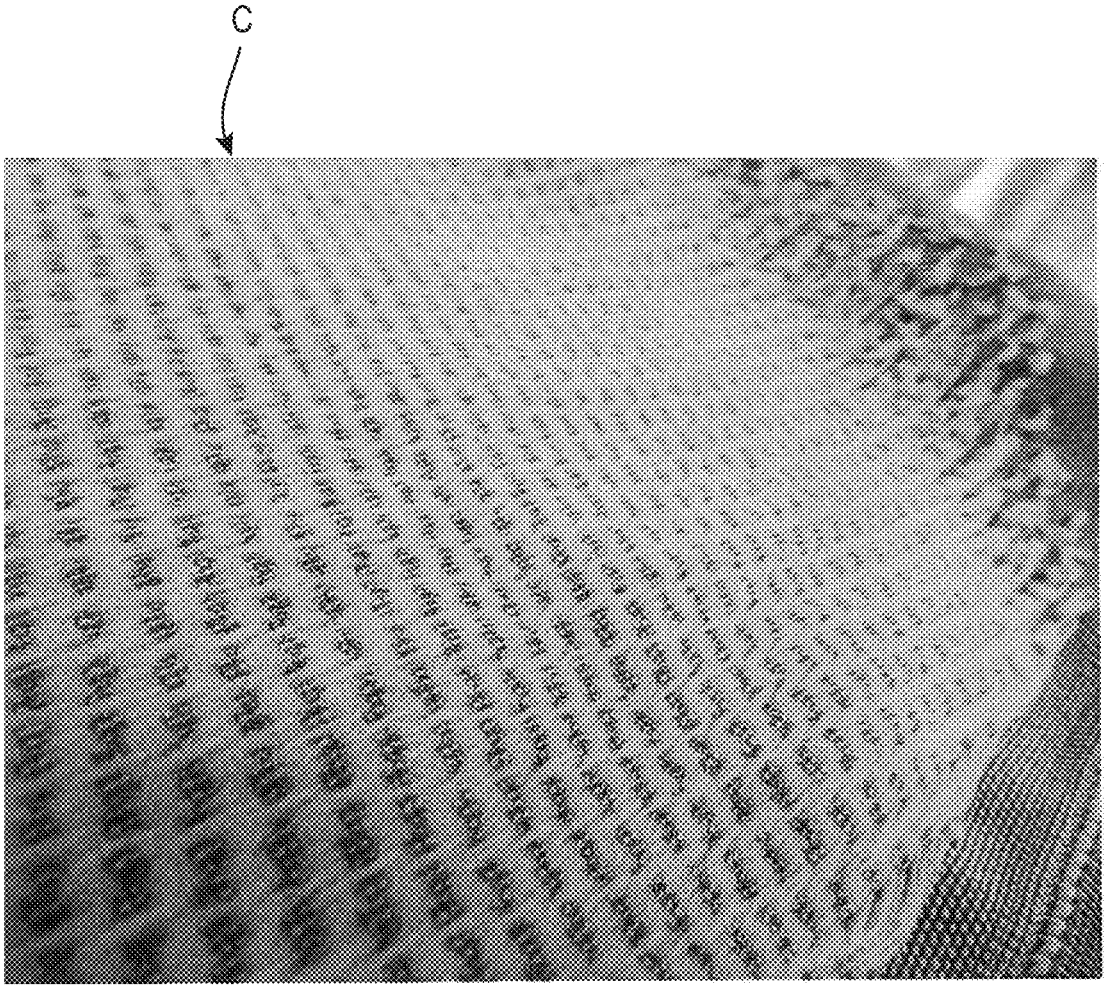
FIG. 8 shows, schematically and from the inside, the third machining diagram in FIG. 7.

According to the present invention, the presence and use of a third yarn allows the machining, shown in FIGS. 7 and 8, to be carried out, which is designed to be slightly breathable, to provide good insulation against the external environment, and to guarantee strong resistance to traction. These sectors (denoted C in FIG. 1) are envisaged where the garment has to offer considerable extension and not create constraints to the wearer's movement such as, for example, at the elbow and knee, which must be able to bend without folds forming, which would cause discomfort, and without causing tension in the fabric, which would limit freedom and the possibility of movement since the garment adheres like a second skin.

In particular, for example, as the elbow is the seat of the muscles that enable hand function if, in addition to the effort that the hand must already make, there is resistance to movement, in terms of both performance and endurance, there would be a considerable loss of power over the short term and, over the long term, phlogistic phenomena may manifest, such as, for example, epicondylitis. Moreover, the structure of the fabric which produces the insulation also offers padding, which can perform an action to protect the part against knocks and bumps.

In addition to that described so far, the third yarn is made of polypropylene or another material with equivalent characteristics which has the ability to warm up when in contact with the skin so that when, during machining, the said yarn is placed inside, this guarantees the part good insulation, which is also helped by the fact that, when the yarn is placed inside for this function, it is machined loosely so as to have more material on the skin. Furthermore, with this arrangement on the internal side of the fabric, as shown in FIG. 6, a sort of sponge machining is created, which reproduces a napped effect which maintains the temperature and traps air, creating a sort of internal "air chamber" that gives the wearer greater comfort and better temperature regulation because the air trapped between the layers of fabric and yarn is closer in temperature to the body than to the external air.

Furthermore, this "air chamber" helps to cushion and absorb any knocks and bumps. This way, the sector of the garment is softer and, consequently, more convenient and comfortable both to put on and to keep on for several hours.

Differently, when the third yarn is positioned on the outside of the fabric and is taut, a light and loose knit is obtained, which makes the garment very breathable in that sector because the machining is carried out using the ground yarn for the main knitting and the base yarn and third yarn are used to create open stitches in the knitting and therefor promote the passage of air.

The combination of the yarn, the thicknesses, and the choice of the formation of the knit lead to the result—depending on the structure to be produced with the yarn—and you get the desired features of either a close knit or and open knit with an alternation of more open machining types for optimal ventilation or a closer, more compact knit for insulation and protection.

The aforesaid organisation leads to an organised fabric that is very breathable and promotes the expulsion of perspiration.

After the predominantly structural description, the invention in question will now be outlined.

When a user intends to carry out a specific sports activity involving a series of repetitive movements which require effort, such user must simply wear a garment according to the present invention designed specifically for the type of sports activity in order to have a correct, adequate temperature regulation and, consequently, good transpiration that guarantees a pleasant feeling on the skin, in addition to optimal comfort. Furthermore, the garment protects the user in various movements and efforts, protecting areas potentially subject to knocks and the user always has dry fabric in contact with the skin.

Thus the present invention achieves the aims set.

The temperature-regulating garment including the air exchange system in question offer a user a garment having zones with differentiated transpiration based on the need for dispersion of the perspiration in a timely manner, offering optimal comfort, excellent breathability, but targeting certain sectors and tailored to needs.

Advantageously, the machining which produces the fabric of the garment lends the garment structural characteristics which translate into functional characteristics in order to obtain effective temperature regulation which leaves the skin dry, promoting the complete expulsion of moisture from the fabric.

Furthermore, the temperature-regulating garment according to the present invention has clearly defined areas which are delimited according to the type of function they have to exert since—depending on the machining—there may be sectors which absorb perspiration and expel it outwards, breathable zones with differentiated levels of transpiration depending on the needs and type of sports activity, insulated and insulating areas that protect the body part from differences in temperature in the external environment, and extensible traction-resistant areas that allow freedom of movement without any limitation or constriction, while still guaranteeing protection of the part.

A further advantage of the temperature-regulating garment including the air exchange system is that they offer the wearer zones which maintain the temperature and wick away moisture from the skin, and allow the moisture to make its way out of the fabric, leaving a sense of dryness which is pleasant to the touch, therefore—when one removes the garment following sports activities—one no longer feels the temperature difference and has a feeling of wellbeing and immediate climatic comfort.

Indeed, advantageously, with the air exchange system, the channels are no longer needed to transport moisture into alternative zones of the fabric, as happens with garments according to the prior art. In addition, the perspiration collected from the skin is drawn out of the fabric into contact with the air for immediate, complete evaporation from the fabric, unlike in prior art garments, where the moisture remains in the fabric.

Furthermore, the garment is designed to become a second skin, adapting to the physiological characteristics, to the morphology of the body, and offering optimal comfort, excellent breathability, adequate air circulation, good muscular support, and protection of the body parts potentially subject to problems.

Advantageously, the air exchange system features sectors that promote correct air circulation in order to have a dry zone with a comfortable, light feeling in contact with the skin and to create organised areas of temperature-regulation and transpiration with expulsion of the moisture created during movement.

Advantageously, the garment in question is very light and thin and therefore is not bulky and gives the wearer optimal freedom of movement.

One advantage obtained with the present garment is that the garment promotes and increase the user's performance, above all keeping the said performance constant throughout the activity, as the uncomfortable and annoying elements are reduced, thereby also making the user more confident during movements and efforts.

In particular, by reducing the stress factors, the condition after the sports activity is also improved, helping users recover their physical fitness more quickly, which is a fundamental condition for those professional activities that involve continuous performance.

Furthermore, as the garment optimally manages transpiration and skin temperature regulation, this reduces perspiration resulting from overheating, therefore reducing the loss of liquids and above all of minerals, which are fundamental for both the strength and the stamina of the sportsperson. This condition prevents an overload of liquids and minerals both before and after performance or even during some sports activities. All this translates into a reduction of acidosis in the arterial-venous circulation, which means the athlete's breathing serves to oxygenate tissues, not to combat acidosis.

A further advantage is due to the fact that the temperature-regulating garment and moisture expulsion system in question are easy to manufacture and works well.

Naturally, further modifications or variants may be applied to the present invention while remaining within the scope of the invention that characterises it.

The invention claimed is:

1. A temperature-regulating garment including an air exchange system, the garment comprising a fabric consisting of a ground yarn which is visible on a rear of the fabric, a base yarn which is visible on a front of the fabric, and a third yarn, the ground yarn and the base yarn forming a knitted structure of the garment, wherein the rear of the fabric faces toward a wearer's body when the garment is worn, and the front of the fabric faces away from the wearer's body when the garment is worn, wherein the garment includes one or more performance areas in which specific performance characteristics are required, and the third yarn is provided in the one or more performance areas so as to provide the specific performance characteristics, the third yarn being hydrophobic, wherein the one or more performance areas include a first performance area designed to absorb and expel perspiration and be breathable, the first performance area having a knitted fabric structure which has a looser knit relative to other areas of the garment in which the specific performance characteristics are not required, such that the first performance area is more breathable than the other areas of the garment in which the specific performance characteristics are not required, wherein the third yarn is inserted into a plurality of rows of knitting within the first performance area so as to create a plurality of first performance rows, each of the first performance rows being a respective one of the plurality of rows of knitting within the first performance area into which the third yarn is inserted, the plurality of first performance rows being parallel to each other and extending in a width direction of the first performance area, wherein in each of the first performance rows, the third yarn begins at one end of the first performance area in the width direction, extends along an entire width of the first performance area, and ends at an opposite end of the first performance area in the width direction, wherein in each of the first performance rows, the third yarn is connected to the ground yarn and the base yarn, and is knitted such that in a first section, the third yarn extends along an inner part of the fabric and is configured to contact skin of the wearer of the garment, in a second section adjacent to the first section, the third yarn extends through the knitted structure of the ground yarn and the base yarn, in a third section adjacent to the second section, the third yarn extends away from the first and second sections along an outer part of the fabric so as to be exposed to an external environment, in a fourth section adjacent to the third section, the third yarn extends through the knitted structure of the ground yarn and the base yarn back to the inner part of the fabric, and the knitting of the first through fourth sections is repeated for the entire width of the first performance area, and wherein respective lengths of the first section and the third section may vary within a same row of knitting, as differences in lengths of the first and third sections correspond to different capacities of the fabric to absorb perspiration and wick the perspiration away towards the external environment.

2. The temperature-regulating garment according to claim 1, wherein the one or more performance areas include a second performance area configured to isolate the skin of the wearer from the external environment so as to avoid heat loss, wherein the third yarn is inserted into a plurality of rows of knitting within the second performance area so as to create a plurality of second performance rows, each of the second performance rows being a respective one of the plurality of rows of knitting within the second performance area into which the third yarn is inserted, the plurality of second performance rows being parallel to each other and extending in a width direction of the second performance area, wherein in each of the second performance rows, the third yarn extends along an entire width of the second performance area, wherein in each of the second performance rows, the third yarn is connected to the ground yarn and the base yarn, and is knitted such that in a first section, the third yarn extends along an inner part of the fabric and is configured to contact skin of a wearer of the garment, in a second section adjacent to the first section, the third yarn extends through the knitted structure of the ground yarn and the base yarn, in a third section adjacent to the second section, the third yarn extends away from the first and second sections along an outer part of the fabric so as to be exposed to an external environment, in a fourth section adjacent to the third section, the third yarn extends through the knitted structure of the ground yarn and the base yarn back to the inner part of the fabric, and the knitting of the first through fourth sections is repeated for the entire width of the second performance area, and wherein in the second performance area, the first through fourth sections are closer together relative to those of the first performance area so as to obtain a thicker, denser fabric in the second performance area relative to the first performance area, and the second performance rows are more compact and denser relative to the first performance rows so as to reduce breathability and the passage of air.

3. The temperature-regulating garment according to claim 1, wherein the first performance area is configured to cover a portion of skin of the wearer, the portion of skin including an area which is most subject to perspiration, and wherein in the first performance area, the lengths of the first and third sections of the third yarn in the first performance rows decrease with distance from the area which is most subject to perspiration such that an arrangement of the third yarn within the first performance rows is varied according to an amount of perspiration produced and an amount of required breathability.

4. The temperature-regulating garment according to claim 1, wherein the first performance area is knitted so as to increase a perspiration absorption capacity of the first performance area, wherein the third yarn does not become impregnated with perspiration and wicks the perspiration away from the fabric towards the external environment and into contact with the air, and wherein in the first performance area, the ground yarn and the base yarn are knitted so as to create ribs, the ribs being configured to keep the fabric raised off the skin of the wearer between adjacent ribs so as to promote transversal air circulation and therefore air flow that is parallel to the skin.

5. The temperature-regulating garment according to claim 1, wherein in the first performance area, the ground yarn and the base yarn are knitted so as to create a plurality of elongate ribs within the first performance rows, the ribs being dimensioned so as not to create thicknesses in the fabric, and wherein portions of the knitted structure between adjacent ribs are loose and breathable.

6. The temperature-regulating garment according to claim 5, wherein the first performance rows are configured to move air in a direction perpendicular to the skin, and wherein the ribs are interposed between the first through fourth sections of the third yarn within the first performance rows so as to create secondary passages of air in which the air moves transversely with respect to the air moved by the first performance rows so as to achieve air circulation in two directions such that perspiration can be evaporated exactly where it occurs.

7. The temperature-regulating garment according to claim 5, wherein the ribs decrease in thickness towards edges of the first performance area due to a decreasing need for air passage further away from a central portion of the first performance area.

8. The temperature-regulating garment according to claim 5, wherein the ribs define high-breathability cells spaced at intervals so as to manage differing degrees of breathability and temperature regulation, and wherein the cells are configured to ensure that there is an exchange of air within the ribs so as to avoid creating areas with different temperatures which would limit breathability and temperature regulation.

9. The temperature-regulating garment according to claim 1, wherein the one or more performance areas include a second performance area configured to be less breathable than the first performance area, to insulate the skin of the wearer against the external environment, to provide cushioning in order to protect the wearer from impacts, and to provide high tensile strength and flexibility, wherein the third yarn is inserted into a plurality of rows of knitting within the second performance area so as to create a plurality of second performance rows, each of the second performance rows being a respective one of the plurality of rows of knitting within the second performance area into which the third yarn is inserted, the plurality of second performance rows being parallel to each other and extending in a width direction of the second performance area, wherein in each of the second performance rows, the third yarn extends along an entire width of the second performance area, wherein in each of the second performance rows, the third yarn is connected to the ground yarn and the base yarn, and is knitted such that in a first section, the third yarn extends along an inner part of the fabric and is configured to contact skin of a wearer of the garment, in a second section adjacent to the first section, the third yarn extends through the knitted structure of the ground yarn and the base yarn, in a third section adjacent to the second section, the third yarn extends away from the first and second sections along an outer part of the fabric so as to be exposed to an external environment, in a fourth section adjacent to the third section, the third yarn extends through the knitted structure of the ground yarn and the base yarn back to the inner part of the fabric, and the knitting of the first through fourth sections is repeated for the entire width of the second performance area, and wherein in the second performance area, the first through fourth sections are elastic and are provided at regular intervals.

10. The temperature-regulating garment according to claim 2, wherein in the second performance area, the third yarn has a warming capacity so as to insulate the skin of the wearer, and is knitted so as to create a terry cloth-like fabric which forms an internal air chamber that traps air between the yarns of the fabric so as to maintain temperature and provide a cushion against potential impacts.

11. The temperature-regulating garment according to claim 1, wherein the third yarn is made of polypropylene.

* * * * *